United States Patent [19]

Miyazaki et al.

[11] 3,981,132

[45] Sept. 21, 1976

[54] DEVICE FOR SUPPORTING A SPINDLE OF AN OPEN-END SPINNING APPARATUS

[75] Inventors: Tsutomu Miyazaki; Takashi Kato; Noriaki Miyamoto, all of Kariya, Japan

[73] Assignees: Kabushiki Kaisha Toyoda Jidoshokki Seisakusho; Daiwa Boseki Kabushiki Kaisha, Osaka, both of Japan

[22] Filed: Oct. 20, 1975

[21] Appl. No.: 624,299

Related U.S. Application Data

[63] Continuation of Ser. No. 429,351, Dec. 28, 1973, abandoned.

[30] Foreign Application Priority Data

June 29, 1973 Japan ..... 48-78070

[52] U.S. Cl. ..... 57/58.89; 57/129; 308/26

[51] Int. Cl.[2] ..... D01H 1/12; D01H 7/12

[58] Field of Search ..... 57/58.89–58.95, 57/129, 130, 135, 77.45; 308/26, 149, 152, 189, 190, 207, 208

[56] References Cited

UNITED STATES PATENTS

| | | | |
|---|---|---|---|
| 2,811,824 | 11/1957 | Sweet | 57/135 X |
| 3,435,604 | 4/1969 | Shotbolt | 57/135 X |
| 3,595,002 | 7/1971 | Korityssky et al. | 57/58.89 |
| 3,599,414 | 8/1971 | Polyakovsky et al. | 57/58.89 |
| 3,711,168 | 1/1973 | Wendel et al. | 308/26 |
| 3,769,785 | 11/1973 | Schiltknecht | 57/58.89 |
| 3,797,962 | 3/1974 | Stahlecker | 57/58.89 UX |
| 3,874,751 | 4/1975 | Okubo et al. | 308/26 |

*Primary Examiner*—John Petrakes
*Attorney, Agent, or Firm*—Burgess Ryan and Wayne

[57] ABSTRACT

An improved device for supporting a spindle of an open-end spinning apparatus is provided with a ring shaped resiliently yieldable member rigidly disposed in a space between a bearing supporting the spindle and an inside cylindrical wall of a bushing member, and an additional ring shaped member rigidly disposed in the above-mentioned space separately from the resiliently yieldable member. To prevent accumulation of heat in the spindle, a plurality of grooves are formed on the peripheral surface of the bearing and/or inside surface of the resiliently yieldable member, and/or the additional member, respectively.

2 Claims, 9 Drawing Figures

MAGNITUDE OF VIBRATION IN mm
0.3
0.2
0.1
0
C
P
1
2
3
4
5
LOAD BY BELT IN kg

MAGNITUDE OF VIBRATION IN mm
0.3
0.2
0.1
0
C
P
1
2
3
4
5
LOAD BY BELT IN kg

MAGNITUDE OF VIBRATION IN mm
0.2
0.1
0
C
P
1
2
3
4
5
6
DRIVING SPEED OF SPINDLE r.p.m
(x 10⁴ r.p.m)

DEVICE FOR SUPPORTING A SPINDLE OF AN OPEN-END SPINNING APPARATUS

This is a continuation of application Ser. No. 429,351, filed Dec. 28, 1973, now abandoned.

SUMMARY OF THE INVENTION

The present invention relates to an improved device for mounting a spindle of an open-end spinning apparatus.

It is well known that, in an open-end spinning apparatus provided with a bearing assembly of a spinning chamber, there is a serious problem due to vibration of the spindle, which is created by the high speed rotation of the spindle. Because of this high speed rotation of the spindle and/or the above-mentioned vibration, a very unpleasant noise is created during the spinning operation. To prevent both the vibration of the spindle and the consequent unpleasant noise, it has been proposed to utilize a ring shaped resiliently yieldable member inserted in a space between the cylindrical bushing member secured to the machine frame or frame support and the outer peripheral surface of a bearing which rotatably supports the spindle. One typical example is shown in the U.S. Pat. No. 3,711,168. The above-mentioned measure assures that the transmission of spindle vibration to the other parts of the open-end spinning machine can be effectively prevented. However, according to our experience in mill operation, it has been found that the following practical and serious problems still remain.

1. At the time of stopping or restarting the spindle, when the running speed of the spindle reaches a critical point at which inherent vibration occurs, the spindle and the bearing thereof vibrate to an abnormally large extent. Further, at the time of stopping the spindle, as a brake force is applied to the free end portion of the spindle, the rotatable spinning chamber secured to the other end of the spindle tends to incline about a geometrical center of the spindle which coincides with a crossing point of the central axis of the spindle and the cross sectional plane of the ring shaped resiliently yieldable member which divides the member into two identical sections. Consequently, vibration of the spinning rotor increases. As is well known, the clearance between the opened portion of the spinning chamber and the member surrounding the spinning chamber is designed to be very small so as to create the so-called Labyrinth effect. For example, the clearance between the peripheral wall of the opened portion of the spinning chamber and a sealing member surrounding the spinning chamber is about 0.3 mm. Consequently, if the abovementioned vibration of the spinning chamber occurs, the spinning chamber contacts the outside sealing member so that the spinning assembly becomes damaged, and leads to the possibility of more serious difficulties such as broken spinning assemblies, injuries to the working person, etc.

2. As the resiliently yieldable member is not made of a heat conductive material, there is a tendency for the heat created by the high speed rotation of the spindle to accumulate in the spindle. This tendency is enhanced if an additional member for preventing the vibration of the spindle is disposed in the space between the bushing member and the outer peripheral surface of the bearing which rotatably supports the spindle, because this additional member interferes with the cooling effect upon the bearing which is created by the air stream discharge from the spinning chamber.

The principal object of the present invention is to provide an improved device for mounting a spindle of an open-end spinning apparatus whereby the above-mentioned drawbacks are eliminated.

In the mounting device of the spindle according to the present invention, an additional ring shaped member is inserted into the space between a bushing member secured to the machine frame or frame support and an outer peripheral surface of a bearing which rotatably supports the spindle, at the side of the rotatable spinning chamber, while a main resiliently yieldable member is inserted in the above-mentioned space at the opposite side of the rotatable spinning chamber, separated from the additional ring shaped member. In the present invention, to prevent heat accumulation in the spindle, it is proposed to adopt a plurality of air passages formed on the bearing or air passages passing through the ring shaped members so that air flow along the direction of the spindle axis can be created in the above-mentioned space. Practical use has confirmed that the above-mentioned drawbacks can be eliminated by the device of the present invention.

Further features and advantages of the present invention will be hereinafter illustrated in detail with reference to the embodiments shown in the accompanying drawings.

DETAILED ILLUSTRATION OF THE INVENTION

Figure 1:
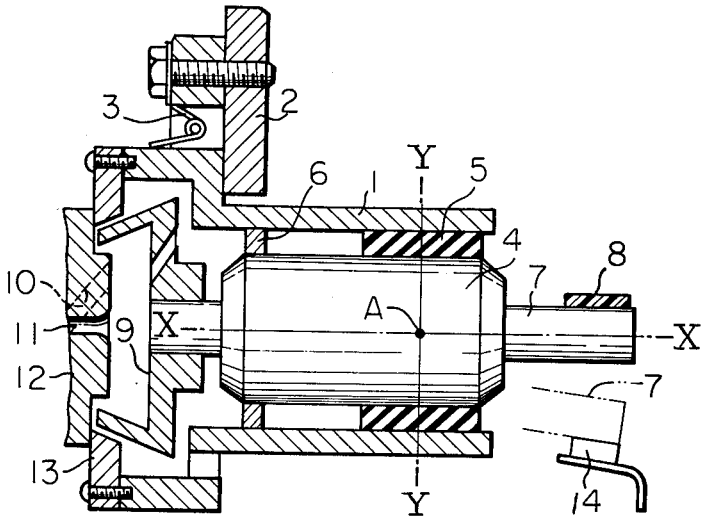
FIG. 1 is a sectional front view of a device for mounting a spindle of an open-end spinning apparatus according to the present invention.

Referring to FIG. 1, in the device for supporting a spindle of the open-end spinning apparatus according to the present invention, a cylindrical bushing member 1 is turnably mounted to a part of a machine frame 2 by a pin 3 so as to turn about the pin 3. A bearing 4 is rigidly mounted in the cylindrical bushing member 1 by way of a ring shaped resiliently yieldable member 5. A free end portion of the spindle 7 contacts a driving belt 8 so that the spindle 7 is driven at a very high speed. A spinning chamber 9 is coaxially secured to the other end of the spindle 7. The opening part of the chamber 9 is covered by a cover 12 provided with a fiber supply passage 10 and an aperture for taking up a yarn from the chamber 9 in such a condition that a small clearance is provided between an edge of the opened part of the chamber 9 and the cover 12. The outside of the above-mentioned edge is surrounded by a sealing member 13 secured to a part of the bushing member 1 with a very small clearance, for example 0.3 mm. According to the above-mentioned condition, the inside of the spinning chamber 9 is separated from the outside atmosphere by the so-called Labyrinth effect. In this particular embodiment, a brake member 14 is disposed at a position adjacently to and below the free end portion of the spindle 7.

As the clearance between the edge of the opened part of the spinning chamber 9 and the sealing member 13 is designed to be small, the following problem has to be solved. That is, at the time of stopping or restarting the spindle 7, when the running speed of the spindle 7 reaches a critical point at which inherent vibration of the spindle 7 occurs, the spindle 7 and its bearing 4 vibrate to an abnormally large extent. Further, at the time of stopping the spindle 7, as a brake force is applied to a free end portion of the spindle 7, the rotational spinning chamber 9 tends to incline about a geometrical center A (as seen in FIG. 1) of the spindle 7 which coincides with a crossing point of the central axis X—X of the spindle 7 and the transverse cross sectional plane Y—Y of the ring shaped resiliently yieldable member 5. If the spinning chamber 9 contacts the sealing member 13, the spinning chamber 9 becomes damaged or broken and increases the possibility of serious accidents occurring.

Figure 3:
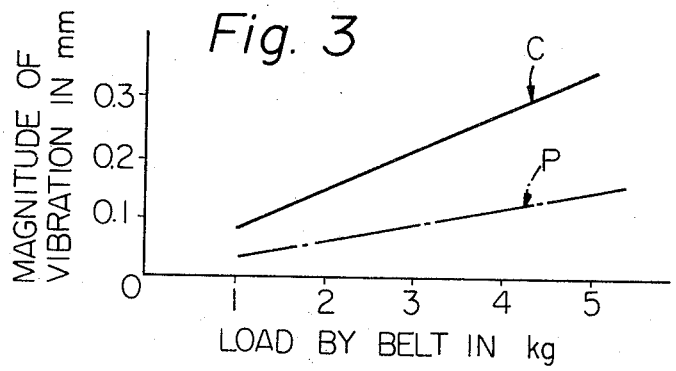
FIGS. 3 – 5 are graphic illustrations of the effect of the spindle supporting device according to the present invention.

To prevent the above-mentioned possible inclination of the spindle 7, an additional ring shaped member 6 is disposed in the space between the bushing member 1 and the bearing 4 at an end portion of the bearing 4 closest to the spinning chamber 9. A plastic material is suitable for making the additional member 6. The effect of the improvement contributed by the additional member is hereinafter illustrated with reference to the graphic illustration of FIG. 3. When a braking force is applied to the free end of the spindle 7 by pushing the belt 8 toward the brake 14 in the conventional spindle assembly, the vibration of the spindle 7 and the spinning chamber 9 is increased, as the pushing force increases and the vibration eventually exceeds the allowable clearance of 0.3 mm, which is the minimum required to create the Labyrinth effect as shown by diagram C in FIG. 3. However, if the additional member 6 is utilized, the vibration of the spindle chamber 9 at the edge of the opened portion thereof can be restricted to less than 0.1 mm, as shown by diagram P in FIG. 3.

Figure 2:
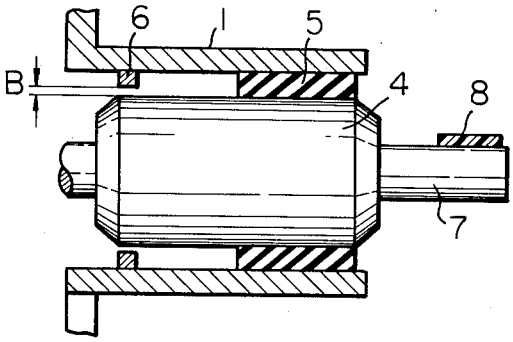
FIG. 2 is a sectional front view of another device for mounting a spindle of an open-end spinning apparatus according to the present invention.

In the embodiment shown in FIG. 2, the additional ring shaped member 6 is fixed to the inside cylindrical surface of the bushing member 1 in a position allowing a cylindrical clearance between this member 6 and bearing 4. For example, this clearance B is about 0.1 mm in this embodiment. In this embodiment, it is permissible to use a metallic material for making the additional member 6.

Figure 4:
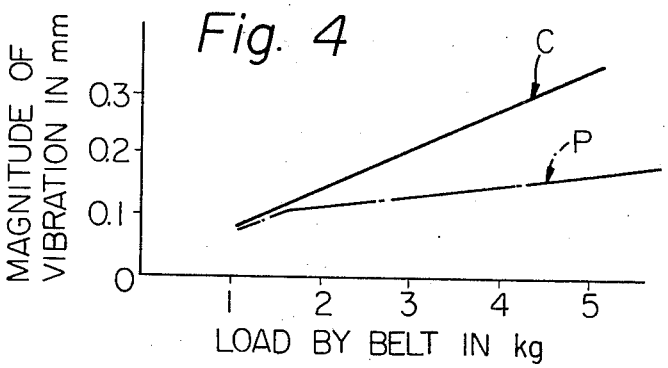

As shown in FIG. 4, an effective result can be achieved by the embodiment of FIG. 1 by applying the additional member 6 shown in FIG. 2. In FIG. 4, the diagram represented by C designates the conventional device, while the diagram P designates the improved device shown in FIG. 2.

According to our mill tests, it is also permissible to apply a modified member 6 fixed on the peripheral surface of the bearing 4 with a clearance between the inside cylindrical wall of the bushing member 1 and the member 6 itself.

Figure 5:
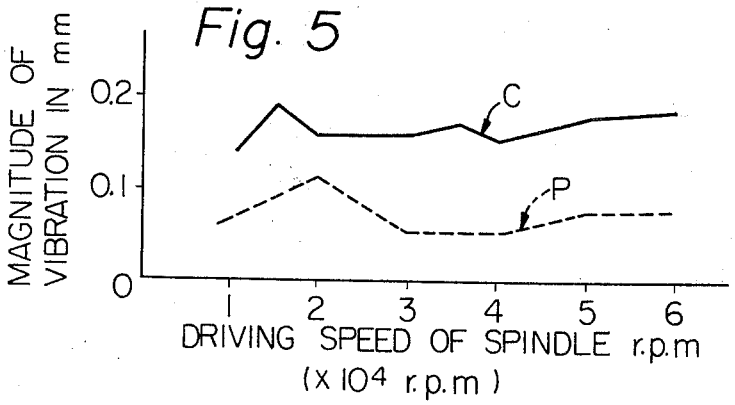
Figure 6:
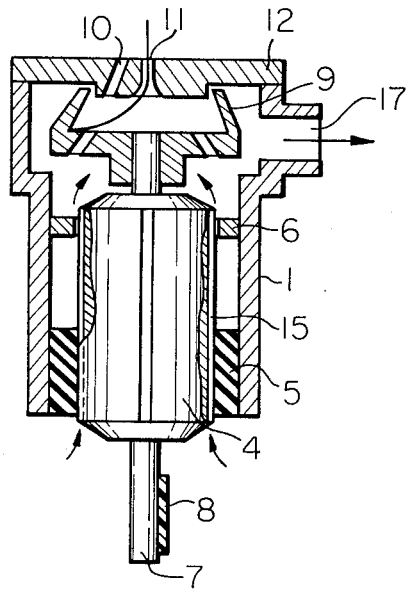
FIG. 6 is a sectional front view of a device which is a modification of the device shown in FIG. 1.

FIG. 5 indicates the relation between the magnitude of vibration of the spinning chamber at the edge of the opened portion and the driving speed of the spindle 7.

As is shown, in the improved device according to the present invention, even though the driving speed changes, at the critical driving speed of the spindle 7, vibration of the spindle 7 is safely restricted to less than 0.1 mm and serious problems caused by the contacting of the spinning chamber 9 with the sealing member 13 can be effectively prevented.

As previously discussed in the preamble portion of this specification, a further problem remains, due to the accumulation of heat in the spindle 7, particularly in the case of the first embodiment shown in FIG. 1. To solve this problem, as shown in FIGS. 6, 7, 8 and 9, it is preferable to provide a plurality of longitudinal grooves 15 on the peripheral surface of the bearing 4, these grooves being parallel to the longitudinal axis X—X of the spindle 7 or a plurality of grooves 16 to the resiliently yieldable member 5 on the inside cylindrical surface thereof, parallel to the spindle axis X—X. Grooves 15 or 16 may also be formed on the bearing 4 or the member 5, respectively.

Figure 7:
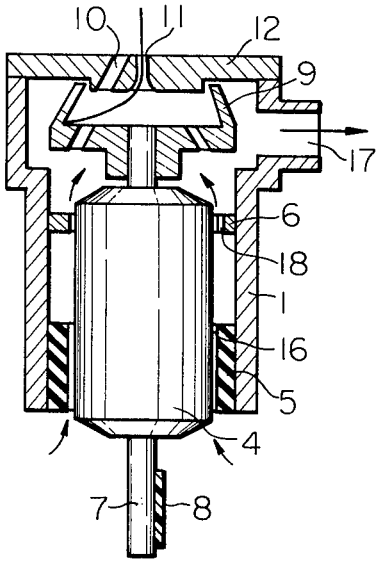
FIG. 7 is a sectional front view of a further modified device according to the present invention.
Figure 8:
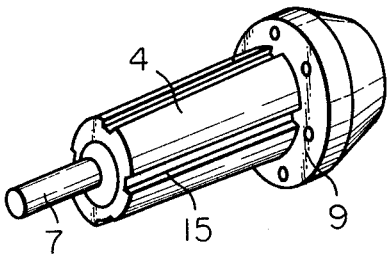
FIG. 8 is a perspective view of an assembly of a spinning chamber together with a spindle, which is utilized for the device shown in FIG. 6.
Figure 9:
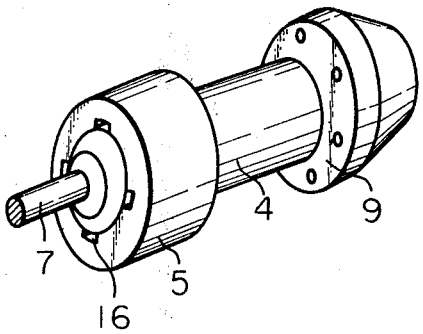
FIG. 9 is a perspective view of a spindle assembly shown in FIG. 8.

As an air stream from the inside of the spinning chamber flows toward the outside of the spindle assembly via a discharge aperture 17, an air stream moving toward the spinning chamber 9, as indicated by arrows, is created so that the spindle 7, heated by the accumulated heat, is effectively cooled. Consequently, any difficulty due to the accumulation of heat in the spindle 7 can be effectively prevented. In the above-mentioned embodiment, the grooves 15 and 16 are formed parallel to the spindle axis X—X, although it is not essential that these grooves 15 and 16 be formed in precisely this fashion. However, it is essential to provide grooves which are capable of creating an air flow from the space between the bushing member 1 and the bearing 4. For example, so-called spiral or radial grooves formed on the outer surface of the bearing or spiral grooves formed on the inside cylindrical surface of the member 5 can be used for the purpose of the present invention. In FIG. 7, a plurality of apertures 18 are provided to the additional member 6 so that a desirable effect, similar to that achieved by the embodiment shown in FIG. 6, can be expected.

According to our repeated mill tests, it was confirmed that the creation of air flow along the peripheral surface of the bearing 4 toward the spinning chamber 9 is very effective even if the additional member 6 is only omitted from the spindle supporting device according to the above-mentioned embodiment. That is, in the case of the spindle supporting device provided with the resiliently yieldable member 5, but without the additional member 6, if a plurality of grooves 15 are formed on the bearing 4 like the embodiment shown in FIG. 6, or a plurality of grooves 16 are formed on the inside cylindrical surface of the member 5 like the embodiment shown in FIG. 7, the very effective cooling of the bearing 4 can be expected.

What is claimed is:

1. In a device for supporting a spindle of an open end spinning apparatus of the type having a spinning chamber coaxially secured to an end of said spindle, said spindle being driven by a driving belt at a free end thereof, a frame support rigidly mounted on said spinning apparatus, a cylindrical bushing member secured to said frame support, a bearing rotatably supporting said spindle, and a ring shaped resilient yieldable member rigidly inserted in a space between said cylindrical bushing member and said bearing for supporting said bearing; the improvement comprising an additional ring shaped member rigidly positioned at a location adjacent to said spinning chamber in said space and spaced from said resiliently yieldable member along the spindle axis for restricting the arc through which the spinning chamber of the spindle may move.

2. In a device for supporting a spindle of the open-end spinning apparatus provided with a spinning chamber coaxially secured to an end of said spindle, a driving belt driving said spindle at a free end thereof, a frame support rigidly mounted on said spinning apparatus, a bearing rotatably supporting said spindle, a cylindrical bushing member secured to said frame support, and a ring shaped resiliently yieldable member rigidly inserted in a space between said cylindrical bushing member and said bearing, an improvement comprising an additional ring shaped member rigidly inserted in said space independently from said resiliently yieldable member and spaced therefrom, said additional member secured to the inside cylindrical wall of said bushing member with a very small annular clearance between the peripheral surface of said bearing member and the inside surface of said additional ring shape member for restricting the arc through which the spinning chamber end of the spindle may move.

* * * * *